United States Patent [19]

Lebet et al.

[11] 4,412,829

[45] Nov. 1, 1983

[54] PRODUCTION OF CIGARETTE FILTER UNITS

[75] Inventors: Jean-Pierre Lebet, Montreux; Michel Berney, Bavois, both of Switzerland

[73] Assignee: Baumgartner Papiers, S.A., Crissier, Switzerland

[21] Appl. No.: 250,390

[22] Filed: Apr. 2, 1981

[30] Foreign Application Priority Data

Apr. 8, 1980 [CH] Switzerland ..... 2692/80

[51] Int. Cl.[3] ..... A24C 5/50

[52] U.S. Cl. ..... 493/48; 141/71

[58] Field of Search ..... 493/48, 47, 43, 46, 493/45; 141/12, 67, 71, 73; 222/64, 56, 61, 373, 518, 542

[56] References Cited

U.S. PATENT DOCUMENTS

| | | | |
|---|---|---|---|
| 3,124,273 | 3/1964 | Remington | 222/542 |
| 3,211,190 | 10/1965 | Vogt | 141/12 |
| 3,482,488 | 12/1969 | Sexstone | 493/48 |
| 3,586,067 | 6/1971 | Han-Jorgen | 141/12 |
| 3,762,281 | 10/1973 | Burrus | 493/47 |
| 3,989,086 | 11/1976 | Bührer | 141/67 |
| 4,185,645 | 1/1980 | Boegli | 493/48 |
| 4,252,527 | 2/1981 | Hall | 493/47 |

FOREIGN PATENT DOCUMENTS

| | | | |
|---|---|---|---|
| 2826108 | 2/1979 | Fed. Rep. of Germany | 222/61 |

*Primary Examiner*—Kuang Y. Lin
*Assistant Examiner*—Kurt Rowan
*Attorney, Agent, or Firm*—Ernest F. Marmorek

[57] ABSTRACT

For the purpose of producing a cigarette filter unit provided with chambers which are filled with a pourable filter material a filter rope provided with chambers having filling openings which terminate to the outside is conveyed past a filler member provided with a filler opening lying sealingly against the latter. In order to obtain satisfactorily filled chambers even at very high advance speeds of the filter rope, the interior of the first chamber of the filler member which interior is connected to the filler opening is maintained during the filling process at an internal pressure which lies above that of the surrounding atmosphere. When then the chambers to be filled come into connection with the filler opening of the filler member an air stream is effected which, in consequence of the pressure difference thus produced, is directed out of the filler member into the chambers to be filled and which conveys filter material out of the filler member into the chambers to be filled of the filter rope. In order to be able to replenish the first chamber without substantial alteration of the internal pressure $P_1$ prevailing therein, with pourable filter material, a second pressure chamber is provided as pressure gate, which chamber is connected to the first pressure chamber and is closable relatively to the outer atmosphere $P_A$ by means of a second closing arrangement, so that the second chamber in turn can be replenished with pourable filter material from the outside without influence upon the internal pressure $P_1$ prevailing in the first chamber.

10 Claims, 29 Drawing Figures

Figures 1, 2, 3:
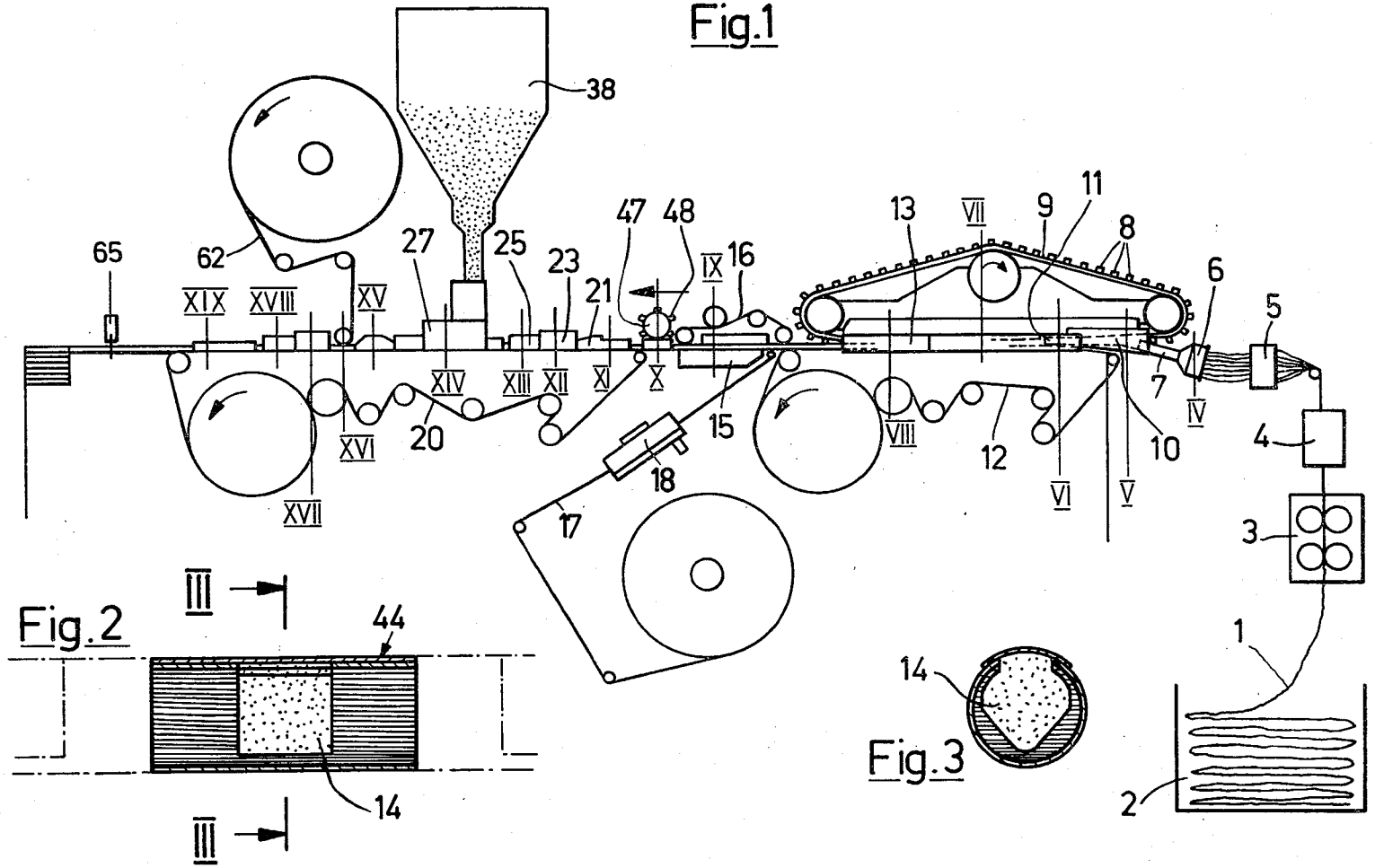

III
III

Fig.19
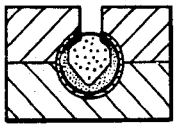
Fig.18
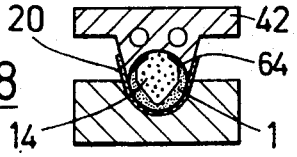
Fig.17
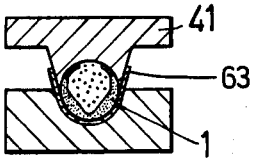
Fig.16
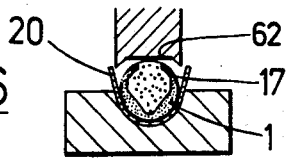
Fig.15
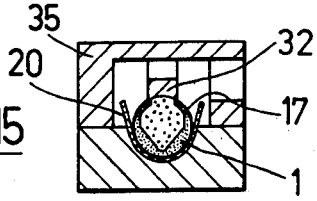
Fig.14
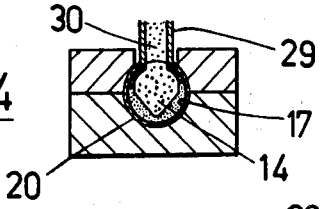
Fig.13
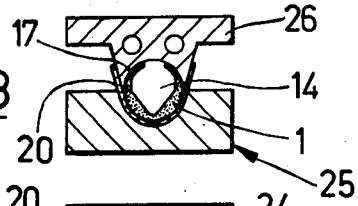
Fig.12
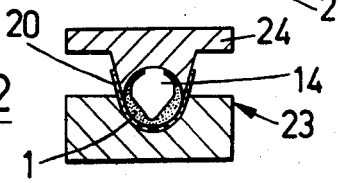
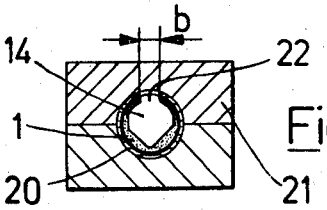
Fig.11
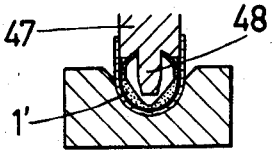
Fig.10
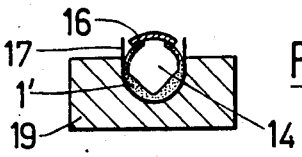
Fig.9
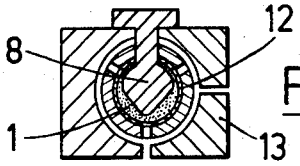
Fig.8
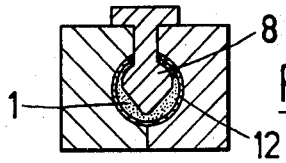
Fig.7
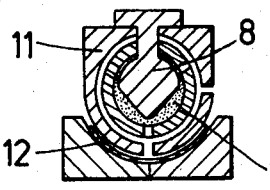
Fig.6
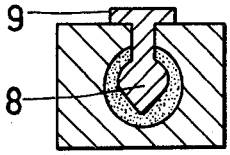
Fig.5
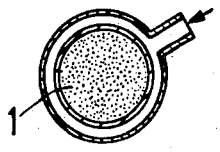
Fig.4

PRODUCTION OF CIGARETTE FILTER UNITS

The invention relates to a method of producing a cigarette filter unit provided with chambers which are filled with pourable and/or fibrous filter material, wherein a filter rod provided with chambers comprising filling openings which terminate to the outside is moved past a filler member provided with at least one filler opening lying sealingly against the same in such a manner that pourable and/or fibrous filter material travels out of the filler member through the chamber filling openings into the chambers to be filled, thereafter the chamber filling openings are closed, and thereupon the filter rod is divided into the desired cigarette filter units, as well as apparatus for performing the method.

Methods of producing chamber filters are already known (DE-OS No. 19 01 120, DE-OS No. 19 32 607) in which an underpressure is produced in the chambers to be filled with pourable filter material for the purpose of obtaining improved filling. However it has been found that in the case of rod advance speeds of more than approximately 80 m/minute these methods operating with under-pressure are no longer satisfactory, because then the degree of filling of the chambers to be filled with pourable filter material becomes unsatisfactory.

It is an object of the present invention to provide a method of producing cigarette filter units provided with chambers which are filled with pourable and/or fibrous filter material, in which chambers still satisfactorily filled with pourable and/or fibrous filter material are obtained even at rod advance speeds of 200 m/minute and more.

This problem is solved according to the invention for a method of the kind referred to above, in that the interior of the filler member connected to the filler opening is maintained during the filling process at an internal pressure which lies above the pressure of the ambient atmosphere, so that when the chambers to be filled come into connection with the filler opening of the filler member, an air stream is effected which, in consequence of the pressure difference thus produced, is directed into the chambers to be filled and which conveys filter material out of the filler member into the chambers to be filled of the filter rod.

In the case of certain filter rod materials and/or cigarette filter dimensions and/or filter materials to be filled into the chambers to be filled, it is advantageous for obtaining an even better degree of filling of the filter chambers, when after at least partly filling the chambers with pourable and/or fibrous filter material the over-pressure prevailing in these chambers is reduced, and the filling openings of these chambers are newly brought into connection with the filler opening of the same or another filler member subjected to over-pressure, so that again, in consequence of the pressure difference produced in this way, an air stream is effected which is directed out of the filler member into the chambers to be filled and which conveys repeatedly filter material out of the filler member into the chambers to be filled of the filter rod, and this decompression-compression process, and thus the filling process, is repeated, under certain circumstances several times.

In order to prevent a portion of the pourable and/or fibrous filter material filled into these filter chambers from being conveyed out of these filter chambers again after the release of the chamber filling openings relatively to the surrounding atmosphere in consequence of the over-pressure prevailing in the filled chambers and produced during filling thereof is reduced at least approximately to the pressure of the surrounding atmosphere prior to the release of the chamber filling openings relatively to the surrounding atmosphere.

It has been found advantageous when an over-pressure in the region of from 0.4 to 3.0 bar is effected in the filler opening of the filler member relatively to the pressure of the surrounding atmosphere.

A further subject of the present invention is apparatus for performing the method according to the invention, having supply means for supplying a filter rod provided with chambers which have filling openings terminating to the outside, a filler member for filling the chambers with pourable and/or fibrous filter material, a closing arrangement for closing the filling openings of the chambers filled with pourable and/or fibrous filter material by means of a closure strip, and having separating means for dividing the filter rod provided with full chambers into defined length sections, which is characterised in that the filler member which lies slidingly and sealingly upon the filter rod and which terminates through at least one filler opening into the chamber filling openings travelling past is provided with at least one first filter material storage chamber which is directly connected to the filler opening, and with at least one second filter material storage chamber which is connected duct which is closable by means of a first closing arrangement, that both filter material storage chambers are constructed as pressure chambers and are connected to supply means for supplying into the interior thereof a pressure gas subjected to over-pressure, that the second storge chamber comprises at least one supply opening which is closable relatively to the outer atmosphere by means of a second closing arrangement, for the purpose of supplying further pourable and/or fibrous filter material into this second storage chamber when a certain quantity of filter material located therein is not attained, and that the first and the second closing arrangement and the compressed gas supply means are so coupled one to the other that always only the one closing arrangement of the two can be opened, and upon opening the first closing arrangement a pressure which is at least approximately equal to that in the first storage chamber prevails in the second storage chamber.

In order to attain even with relatively poorly pourable filter materials and at very high rod speeds nevertheless a good filling degree of the filter chamber, it is advantageous when the filler opening of the filler member is divided into a plurality of sections, and at least always one decompression chamber which lies slidingly and sealingly upon the filter rod and which terminates into the chamber filling openings moving past is arranged between always two adjacent sections, for the purpose of reducing the over-pressure prevailing in the chambers travelling past the same. In this case it is advantageous when for regulating the gas pressure prevailing therein the decompression chambers are connected through at least one respective compressed gas exhaust pipe to at least one pressure regulator arrangement.

In order to obtain highly simple replenishing of the first storage chamber with filter material stored in the second storage chamber, it is additionally advantageous when the second storage chamber is arranged above the first storage chamber.

For the purpose of rendering automatic replenishing the two storage chambers and for preventing the state that suddenly there is no more filter material in the first storage chamber for delivery to the chambers to be filled, it is advantageous when the first and the second storage chamber are each provided with an arrangement which monitors the filling state prevailing in the respective storage chamber and which, when the level drops below a certain minimum filling state for replenishing the respective storage chamber with pourable or fibrous filter material, effects opening the closure arrangement provided at the inlet end of the respective storage chamber.

Furthermore, it has been found advantageous that the first and/or the second closure arrangement comprises a closure member which is displaceable in its axial direction and is provided with a conically-shaped outer surface and which co-operates with a seat which has the shape of a truncated-cone-like outer surface, wherein the closure member or the seat, while forming at least two ribs which extend with sharp edges at an acute or obtuse angle on its outer surface, is provided along its periphery with at least one groove and the apex of the closure member is directed in opposition to the through-flow direction.

Further advantageous augmented embodiments of the apparatus according to the invention are subject of claims 11 to 13.

Figures 20A, 25:
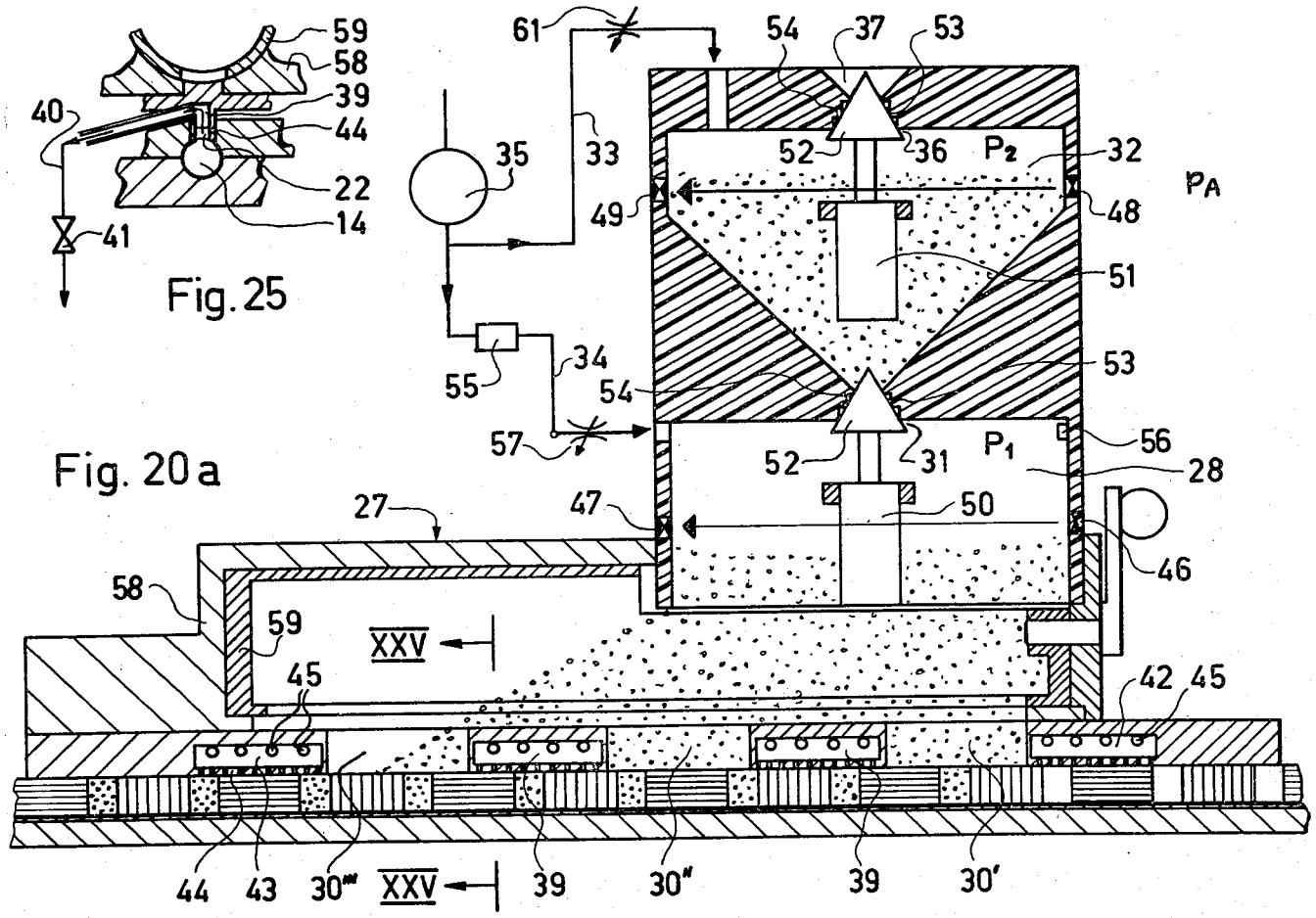
Figure 21:
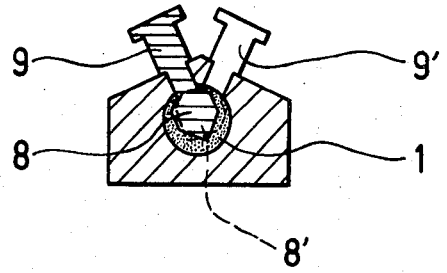
Figure 22:
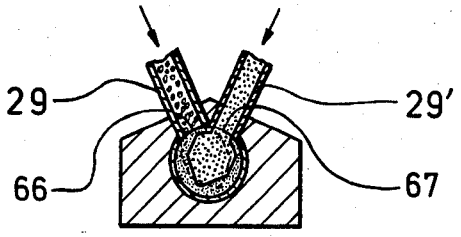
Figure 23:
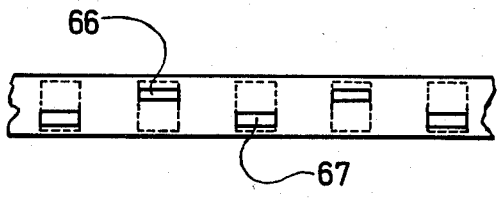
Figure 24:
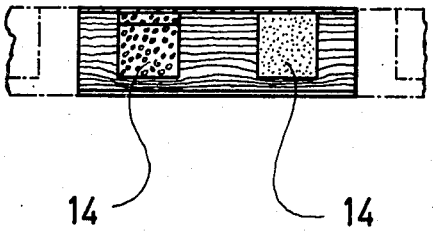

The invention will be explained below by way of example with reference to the drawing. There are shown in FIG. 1 a diagrammatic side view of a constructional example of apparatus according to the invention for the production of cigarette filters provided with chambers;

FIG. 2 a longitudinal section through a cigarette filter produced by means of the apparatus illustrated in FIG. 1;

FIG. 3 a section on the line III—III in FIG. 2;

FIGS. 4 to 19 various sections on the lines IV—IV to XIX—XIX in FIG. 1;

FIGS. 20*a* to 20*e* the filling station of the apparatus illustrated in FIG. 1 in the various phases of replenishing, in longitudinal section;

FIG. 21 a section analogous to FIG. 5 for illustrating the arrangement of two forming chains in the production of cigarette filters having two chambers;

FIG. 22 a section analogous to FIG. 21 for illustrating the arrangement of two filling stations disposed laterally adjacent one to the other in the production of cigarette filters having two chambers which are filled with different material;

FIG. 23 a view from above upon the filter rod produced in accordance with FIG. 21;

FIG. 24 a longitudinal section analogous to FIG. 2 through a cigarette filter provided with two chambers, and FIG. 25 a section on the line XXV—XXV in FIG. 20*a*.

As may be seen from FIG. 1, in the apparatus illustrated an acetate-cellulose rod 1 is drawn off a bale 2, then fed to a crinkling and stretching unit 3 and moistened with a softener in a chamber 4.

The flat rod 1 treated in this way is thereupon divided in a unit 5 and then fed to an air nozzle 6, such as known for example from U.S. Pat. No. 3,050,430, for the purpose of uniformly gathering the rod fibres to form a loose rod of circular cross-section.

Subsequently the rod 1 is supplied continuously in the loose state to a guide member 10 by means of a guide tube 7 connected to the nozzle 6; the guide member 10 surrounds the conveyor belt 9 provided with chamber forming members 8, and the rod is moved gradually into engagement with the travelling chamber forming members 8.

The conveyor belt may, for example, consist of a reinforced gearwheel belt to which the chamber forming members 8 are fastened.

By means of the guide member 10, the rod fibres are placed uniformly around the chamber forming members 8, are relieved of tension forces in the longitudinal direction of the rod, thanks to the said members, slowly pressed more strongly around the chamber forming members 8, reduced to a smaller rod diameter, and then the rod 1 which has been formed in this way around the chamber forming members 8 is supplied to a heating member 11 where hot steam having a temperature of approximately 120° C. is passed through the rod 1 (see also FIG. 6).

Immediately beyond the heating member 11 the rod 1 heated in this manner is moved at once into engagement with the conveyor and former belt 12, enclosed by the same, and gradually compressed even further to the desired final diameter.

At the end of the forming path a cooling member 13 (see also FIG. 8) is arranged by means of which cold air is passed through the finished formed rod 1, in order to fix the individual fibres of the rod in their position.

After fixing the rod shape, the chamber forming elements 8 are moved out of the chambers 14 formed by them. Owing to the fact that the chamber forming elements 8 are embedded for a relatively long period of time in the rod material during the fixing of the position of the latter, even at rod advance speeds of 200 m/min and more, and the chamber forming elements 8 are not removed from the shape-retaining rod formed in this way until after termination of the fibre fixing process, a rod 1' provided with chambers 14 is obtained which is dimensionally very stable and accurately shaped.

This rod 1' formed in this way is subsequently supplied to a wrapping station 15 where on the one hand by means of an endless presser belt 16 lying upon the upper surface of the rod 1', fibres which possibly project upwardly owing to the removal of the chamber forming members 8 from the chambers 14 formed thereby, are pressed again against the surface of the rod, in order to obtain a clean uniform outside of the rod 1'. Simultaneously a wrapper strip 17 is supplied from below which had been provided on the side coming into contact with the surface of the rod with a heat-softenable adhesive in the adhesive depositing station 18. This adhesive is heated in the wrapping station 15 by means of a heating member 19 which can be pressed from below against the rod 1' and the wrapper strip 17 is adhesively secured thereby to the lower side of the rod 1'.

Obviously it is also possible to omit this wrapper strip 17, since the rod 1' by itself has sufficient form stiffness.

In order to avoid that the rod rotates about its longitudinal axis, as may also be seen from FIG. 7, a rotatable guide wheel 47 provided with guide cams 48 is arranged above the rod 1' beyond the wrapping station 15 and the guide cams 48 thereof engage laterally guiding into the filling openings 22 of the chambers 14.

Thereupon the rod 1' formed and wrapped in this way is fed by means of a further conveyor belt 20 to a forming member 21 (see also FIG. 11) in which the wrapper strip 17 is placed around the rod 1' except for a slot width which corresponds to the width b of the chamber filling opening 22. Thereafter, in a heating station 23, the adhesive of the portion of the wrapper strip 17 which is not yet adhesively attached to the rod 1' is heated by means of a heating member 24 which lies upon the entire upper rod half, and in the cooling station 25 following therebehind the adhesive is caused to set by means of a cooling member 26 cooled for example by water and thereby the wrapper strip 17 is completely secured adhesively to the outside of the rod 1'.

After the rod 1' is wrapped thus with the wrapper strip 17, the rod 1' provided with chambers 14 is supplied to a filler member 27 which is illustrated more closely in detail and in the various phases of replenishing in FIGS. 20*a* to 20*e* and which serves for introducing into the chambers 14 pourable filter material, such as for example active carbone.

As may be seen from FIGS. 20*a* to 20*e* as well as FIG. 13, the filler member 27 is provided on its downwardly directed outlet side with a slider member 29 which lies slidingly and sealingly upon the side edges of the wrapper strip 17 as well as upon the peripheral regions exposed therebetween of the filter rod or filter rope 1'.

The filler member 27 which lies in this way slidingly and sealingly on the upper surface of the filter rope 1' is provided with a first storage chamber 28 which is directly connected to the filler opening or the outlet slot 30, respectively, as well as to a second storage chamber 32 which is connected to the first storage chamber 28 by means of a connecting duct closable by means of a first closing arrangement 31. Both filter material storage chambers 28 and 32 are constructed as pressure chambers and are connected through feed pipes 33 and 34, respectively, to an air compressor 35 for the supply into their interior of air subjected to an over-pressure.

The second storage chamber 32 comprises a supply opening 37 which is closable relatively to the outer atmosphere $p_A$ by means of a second closing arrangeent 36, for the purpose of supplying pourable filter material from the storage container 38 (FIG. 1).

The outlet slot 30 in the slider member 29 is divided into a plurality of sections 30', 30'' and 3''', for the purpose of obtaining repeated flow of compressed air into the interior of the chambers 14 to be filled; between always two adjacent sections 30', 30'' and 30'', 30''', respectively, a decompression chamber 39 each is arranged which lies slidingly and sealingly on the upper surface of the filter rope 1' and which terminates into the chamber filling openings 22 moving past (see FIG. 11), for the purpose of reducing the over-pressure prevailing in these chambers 14 moved past the same.

For the purpose of adjustment to the various sorts of filter granulate, chamber sizes and rope advance speeds, each of the decompression chambers 39 is connected by means of a respective air exhaust pipe 40 to a pressure regulator device 41 for the purpose of regulating the air pressure prevailing in them.

For the purpose of obtaining an improved air circulation into the chambers 14 to be filled and through the same, that is to say for obtaining an improved chamber filling, considered in the direction of movement of the rope 1' immediately in front of the outlet slot 30 and bordering on same, a compensation chamber 42, is provided which lies slidingly and sealingly on the upper surface of the filter rope 1' and which terminates into the chamber filling openings moving past. In its construction this compensation chamber 42, for example, is identical with the decompression chambers 39, the manner of working thereof differing from the latter in as much as pressure is not yet reduced in the freshly supplied chambers 14. The manner of functioning of this compensation chamber 42 is such that when the filling opening 22 of the advanced chamber 14 to be filled on the one hand is located alread below the outlet slot 30', but on the other hand is still located below the compensation chamber 42, the air which flows in from the first storage chamber 28 and carries with it pourable filter material, can escape again from the chamber 14 through the compensation chamber 42, so that a relatively intensive through-flow through the chamber 14 to be filled and thus as far as possible optimum filling of the latter is attained, since the pourable filter material carried away is no longer deflected upwardly in the chamber 14 and conveyed out of the latter through the compensation chamber 42 in consequence of gravity and inertia thereof.

The manner of functioning of the decompression chambers 39 is analogue to the functioning of the compensation chamber 42, however with the difference that additionally still the overpressure prevailing in the chambers 14 supplied is reduced and at both end faces located in the outlet slot 30 a respective fresh inflow into the chambers 14 to be filled is obtained.

Doctor ribs 44 arranged in the decompression chambers 39 and 43 and in the compensation chamber 42 lie upon the upper surface of the filter rope 1', remove all grains of granulate located on this rope surface and reduce additionally a discharge of granulate already located in the chambers 14 to be filled. Passage bores 45 which enlarge conically to the outside prevent granulate grains which possibly travel nevertheless into the chamber 39, 42 or 43, respectively, from getting stuck in the passage bores 45 upon their transfer into the discharge pipe 40. The smallest diameter of these passage bores 45 amounts to approximately 0.3 to 0.4 mm.

Considered in the direction of movement of the filter rope 1' immediately behind the outlet slot 30, there is provided a further decompression chamber 43 which is constructed analogue to the chambers 39 and 42 and which serves for reducing the overpressure prevailing in the chambers 14 moved past this decompression chamber 43, prior to the release of the chamber filling openings 22 in relation to the surrounding atmosphere $p_A$, preferably to at least approximately that of the latter, in order to avoid that, in consequence of the overpressure previously effected in the chambers 14 below the outlet slot 30, upon release of the chamber filling openings 22 relatively to the surrounding outer atmosphere $p_A$ pourable filter material is conveyed out of the tightly filled chambers 14.

As may be seen further from FIGS. 20*a* to 20*e*, the first and the second storage chamber 28 and 32, respectively, is provided with always one optical barrier arrangement 46,47 or 48,49, respectively, which monitors the filling state prevailing in the respective storage chamber and which, upon dropping below a certain minimum filling state for replenishing the respective storage chamber 28 or 32, respectively, with pourable filter material, effects opening the closure arrangement 31 or 36, respectively, provided at the outlet end of the respective storage chamber 28 or 32, respectively.

The two closure arrangements 31 and 36 are actuated each by an electrically actuated lifter magnet 50 and 51, respectively, the control being such that always only one of the two closing arrangements 31 and 36 can be opened, since for obtaining a highly uniform filling of the chambers 14 with pourable filter material, the air pressure prevailing in the first storage chamber 28 should always remain equally high as far as possible.

The two closing arrangements 31 and 36 are so constructed that, even when pourable filter granulate, such as for example active carbon, is used, they are always still in the position to close at least approximately in an air-tight manner.

Therefore the two closing arrangements 31 and 36 comprise always one closure member 52 which is provided with a conically shaped outer surface and is displaceable in its axial direction and which co-operates with a seat 53 comprising the shape of a truncated-cone-shaped outer surface.

In order to prevent granulate grains from being able to render impossible a closure of the closing arrangements 31 and 36, respectively, the seat 53 is provided with a plurality of grooves along its periphery, forming thereby a plurality of ribs 54 ending with sharp edges at an acute angle on its outer surface.

When the closing arrangements 31 and 36 are closed, the air compressor 35 effects in the second storage chamber 32 an internal over-pressure of for example 2 bar and, by means of the pressure reducing valve 55 inserted in the supply pipe 34, a lower internal over-pressure of for example 1.8 bar in the first storage chamber 28, so that even relatively pourly pourable filter material, upon opening the closing arrangement 31, is conveyed perfectly from the second storage chamber 32 into the first storage chamber 28.

A pressure sensor 56 arranged in the interior of the first storage chamber 28 senses continuously the air pressure prevailing in this chamber 28 and controls a regulating device 57 arranged in the supply pipe 34 in such a manner that in the first storage chamber 28 continuously always a highly constant air pressure prevails, because only then a uniform filling with pourable filter material of the chambers 14 is possible which are conveyed extremely rapidly past the filler member (27).

In order to be able to adjust the magnitude of the outlet slot 30 of the filler member 27 to the grain size of the pourable filter material used, the lower portion 58 of the first storage chamber 28 is of semi-cylindrical construction, this portion 58 having a scoop-shaped closure member 59 arranged therein which lies slidingly against the inside of this cylinder-shaped member 58 and is pivotal about its longitudinal axis by means of the hand grip 60.

The replenishing process will now be explained below in detail with reference to FIGS. 20*a* to 20*e*.

In the situation illustrated in FIG. 20*a* both closing arrangements 31 and 36 are in their closing position, and the pressure $p_2$ in the second chamber 32 lies for example approximately 0.1 to 0.2 bar above the internal pressure $p_1$ prevailing in the first storage chamber 28. The optical barrier arrangement 46,47 arranged in the first storage chamber 28 detects then a lowering of the pourable filter material stored in this storage chamber 28 below a predetermined minimum level, whereupon the first closing arrangement 31 is opened and the pourable filter material intermediately stored in the second storage chamber 32 flows downwards into the first storage chamber 28 (FIG. 20*b*). This flow-over time should be dimensioned as short as possible in order to prevent the pressure $p_1$ desired in the first storage chamber 28 being varied too much.

Figure 20C:
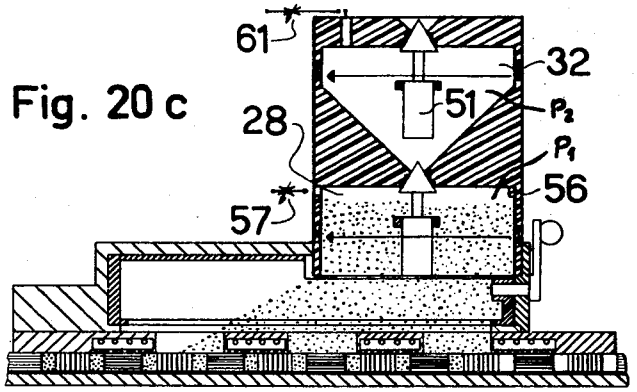
Figure 20E:
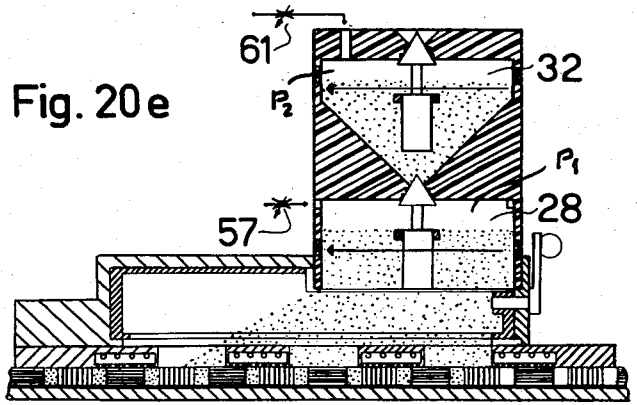
Figure 20B:
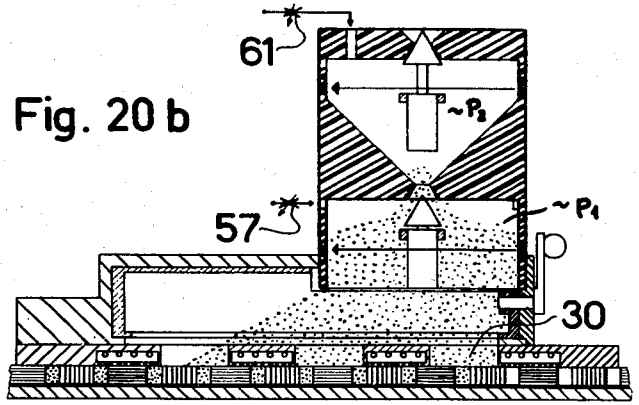
Figure 20D:
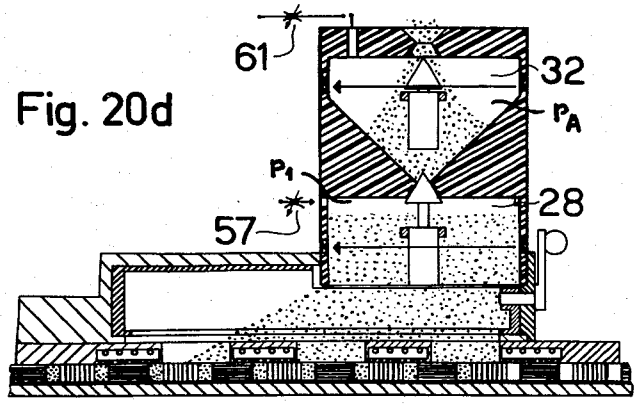

After the delivery of filter material stored in the second storage chamber 32 to the first storage chamber 28 located therebelow, the first closing arrangement 31 is closed again, as may be seen from FIG. 20*c* and thereupon, provided the optical barrier arrangement 48,49 disposed in the second storage chamber 32 indicates too low a stored quantity, the second closing arrangement 36 is opened (see FIG. 20*d*) until the filter material which then flows out of the storage container 38 into the second storage chamber 32 has attained a level which lies above the level of the optical barrier arrangement 48,49. During this replenishing process the ambient atmospheric pressure $p_A$ prevails in the second storage chamber 32 in consequence of the open second closing arrangement 36; this, however, has no influence upon the second storage chamber 28, since the first closing arrangement 31 is closed.

As soon as the second storage chamber 32 has been replenished with the predetermined quantity of pourable filter material, the second closing arrangement 36 is closed again and, by opening the second regulating device 61 arranged in the supply pipe 33, the previous pressure $p_2$ which lies slightly above the pressure $p_1$ prevailing in the first storage chamber 28 is effected in the second storage chamber 32 (FIG. 20*e*), whereupon the cycle is closed and the phase according to FIG. 20*a* follows again.

Beyond the filler member 27, a closure strip 62 the width of which is slightly greater than the width of the chamber filling opening is supplied from above, placed over the latter and adhesively secured by means of a heatable element 63, on the exposed surface of the filter element rod 1' and on the lateral edges of the wrapper strip 17 by softening the thermoplastic coating of the closure strip 40. This heatable element 63, too, is attached in an upwardly pivotal manner, so that it may be lifted off the stationary closure strip 62 at standstill of the apparatus.

In order to obtain an accurate external shape of the cigarette filter units, the rope provided with the hot closure strip 62 is passed through under a water-cooled cooling member 64, where the softened thermo-plastic coating of the closure strip 62 solidifies.

After the filter rope has been adhesively closed, it is fed to a separating device 65 where it is divided in a manner such that the length of each filter structure amounts to four times or six times the length of a single filter unit intended for a cigarette.

As may be seen from FIGS. 21 and 22, it is also possible for the production of cigarette filters having two chambers 14,14' (see FIG. 24) that chambers 14, 14' are formed by means of two conveyor elements 9,9' which are arranged in planes extending inclined one to the other and extending in the chamber forming region through the longitudinal axis of the rope and the chamber forming region of which are arranged successively in a mutually alternating manner; the chamber filling openings 22, 22' of the chambers 14, 14' are likewise located in an alternating manner on different sides of a plane extending through the longitudinal axis of the rope.

As may be seen from FIG. 22, with such a construction of the rod 1' provided with chambers 14, 14' it is possible to fill different granulate into successive chambers 14 and 14', in that the first material is filled through the chamber filling openings 22 which are located on a first rope surface line 66 and formed by the first conveyor belt 9 provided with the chamber forming elements 8, and the second material is filled through the chamber filling openings 22' which are located on a second rope surface line 67 and formed by the second conveyor element 9' provided with chamber forming elements 8. This method is advantageous in particular when two filter materials are used which are not to be mixed with each other for optimum utilisation of their efficiency.

We claim:

1. Apparatus for producing a cigarette filter unit, having supply means for supplying a filter rod provided with chambers comprising filling openings which terminate to the outside surface of the filter rod, a filler member for filling the chambers with pourable and/or fibrous filter material, a closing arrangement for closing the filling openings of the chambers filled with pourable and/or fibrous filter material, by means of a closure strip, and having divider means for dividing into defined length sections the filter rod provided with full chambers, characterised in that the filler member which lies slidingly and sealingly on the filter rod and which terminates by at least one filler opening into the chamber filling openings moving past, is provided with at least one first filter material storage chamber which is directly connected to the filler opening, and with at least one second filter material storage chamber which is connected to the first storage chamber by way of a connecting duct which is closable by means of a first closing arrangement, that both filter material storage chambers are constructed as pressure chambers and are connected to controllable supply means for the controlled supply into the interior thereof of a pressure gas subjected to overpressure, that the second storage chamber comprises at least one supply opening closable by means of a second closing arrangement for supplying to this second storage chamber further pourable and/or fibrous filter material when a certain quantity of filter material located therein is too small, and that the first and the second closing arrangement and the supply means for compressed gas are coupled together in such a manner that always only one of the two closing arrangements can be opened, and that upon opening the first closing arrangement a pressure prevails in the second storage chamber which is at least approximately equal to the pressure in the first storage chamber.

2. Apparatus according to claim 1, characterised in that the filler opening is divided into a plurality of sections, and that always between two adjacent sections at least always one decompression chamber is arranged which lies slidingly and sealingly on the filter rod and terminates into the chamber filling openings travelling past, for the purpose of reducing the over-pressure prevailing in these chambers moved past them.

3. Apparatus according to claim 2, characterized in that for the purpose of regulating the gas pressure prevailing in them the decompression chambers are connected to at least one pressure regulator arrangement by means of at least one respective compressed gas exhaust pipe.

4. Apparatus according to claim 1, characterised in that the second storage chamber is arranged above the first storage chamber.

5. Apparatus according to claim 1, characterised in that the first and the second storage chamber are provided with a respective arrangement which supervises the filling state prevailing in the respective storage chamber and which, when a certain minimum filling state is not exceeded, effects opening of the closure arrangement provided on the entry side of the respective storage chamber, for the purpose of filling up the respective storage chamber with pourable and/or fibrous filter material.

6. Apparatus according to claim 1, characterised in that the first and/or the second closure arrangement comprises a closure member which is displaceable in its axial direction and is provided with a conically-shaped outer surface and which co-operates with a seat which comprises the shape of a truncated-cone-like outer surface, wherein the closure member or the seat, while forming at least two ribs which extend with sharp edges on its outer surface at an acute or obtuse angle and extend along its periphery, is likewise provided with at least one groove along its periphery, and the apex of the closure member is directed against the flow-through direction.

7. Apparatus according to claim 1, characterised in that it is provided with a pressure regulator arrangement which effects in the first storage chamber a highly constant gas over-pressure, advantageously air over-pressure, preferably in the region of from 0.4 to 3.0 bar, and in the second storage chamber a gas over-pressure which advantageously lies at least 0.2 bar above the gas pressure prevailing in the first storage chamber, preferably in the region of from 0.6 to 3.2 bar.

8. Apparatus according to claim 1, characterised in that, considered in the direction of movement of the rod beyond the filler opening, at least one decompression chamber is provided which lies slidingly and sealingly on the filter rod and which terminates into the chamber filling openings travelling past, for the purpose of reducing the overpressure prevailing in the chambers moved past them, preferably to approximately atmospheric pressure, prior to the release of the chamber filling openings to the surrounding atmosphere, and which is connected to the filler opening of the filler member by means of a common slide surface which lies sealingly upon the filter rod.

9. Apparatus according to claim 1, characterised in that, considered in the direction of movement of the rod directly in front of the filler opening, at least one compensation chamber is provided which borders on the latter and lies slidingly and sealingly upon the filter rod and which terminates into the chamber filling openings moving past, for the purpose of influencing the pressure prevailing in the chambers moved past the said compensation chamber which is connected to the filler opening of the filler member by means of a common slide surface which lies sealingly upon the filter rod.

10. Apparatus according to claim 9, characterised in that the compensation chamber is constructed as a decompression chamber and is connected by means of at least one compressed gas exhaust pipe to at least one pressure regulator arrangement, for the purpose of regulating the gas pressure prevailing in it.

* * * * *